US005749030A

United States Patent [19]

Park

[11] Patent Number: 5,749,030

[45] Date of Patent: May 5, 1998

[54] CLEANING DEVICE FOR ELECTROPHOTOGRAPHIC PROCESSOR

[75] Inventor: Hyoung-Koo Park, Seoul, Rep. of Korea

[73] Assignee: SamSung Electronics Co., Ltd., Suwon, Rep. of Korea

[21] Appl. No.: 732,182

[22] Filed: Oct. 16, 1996

[30] Foreign Application Priority Data

Oct. 16, 1995 [KR] Rep. of Korea ..... 1995-35654

[51] Int. Cl.[6] ..... G03G 15/02; G03G 21/00

[52] U.S. Cl. ..... 399/148; 399/174; 399/350

[58] Field of Search ..... 399/148, 349, 399/350, 358, 174, 100

[56] References Cited

U.S. PATENT DOCUMENTS

| | | |
|---|---|---|
| 5,260,754 | 11/1993 | Yano et al. . |
| 5,452,065 | 9/1995 | Bell . |
| 5,479,243 | 12/1995 | Kurokawa et al. . |
| 5,506,669 | 4/1996 | Inoue et al. . |
| 5,541,717 | 7/1996 | Saito et al. . |
| 5,543,906 | 8/1996 | Kanda . |
| 5,557,375 | 9/1996 | Nagayasu et al. . |
| 5,559,591 | 9/1996 | Kato et al. . |
| 5,559,593 | 9/1996 | Yoshinaga et al. . |

FOREIGN PATENT DOCUMENTS

| | | |
|---|---|---|
| 4-304476 | 10/1992 | Japan . |
| 5-94118 | 4/1993 | Japan . |
| 7-92767 | 4/1995 | Japan . |
| 7-160162 | 6/1995 | Japan . |

*Primary Examiner*—Joan Pendegrass
*Attorney, Agent, or Firm*—Robert E. Bushnell, Esq.

[57] ABSTRACT

A cleaning device of an electrophotographic processor having a conductive cleaning blade for performing both charging and cleaning operations. The cleaning device of an electrophotographic processor includes a conductive cleaning blade installed at the cleaning device for removing residual toner remaining on an outer surface of a photosensitive drum, and a high pressure unit electrically connected to the conductive cleaning blade for applying voltage to the conductive cleaning blade to charge the surface of the photosensitive drum during charging operation and to subsequently clean the surface of the photosensitive drum from residue toner during cleaning operation.

13 Claims, 3 Drawing Sheets

CLEANING DEVICE FOR ELECTROPHOTOGRAPHIC PROCESSOR

CROSS REFERENCE TO RELATED APPLICATION

This application makes reference to, incorporates the same herein, and claims all benefits accruing under 35 U.S.C. §119 from an application for CLEANING DEVICE FOR ELECTROPHOTOGRAPHIC PROCESSOR earlier filed in the Korean Industrial Property Office on 16 Oct. 1995 and there duly assigned Serial No. 35654/1995.

BACKGROUND OF THE INVENTION

1. Technical Field

The present invention relates to an image forming apparatus using an electrophotographic process such as a laser beam printer, a copier and facsimile machine, and more particularly, relates to a cleaning device for simultaneously performing charging and cleaning operations in such an image forming apparatus.

2. Background Art

In an image forming apparatus such as a copier, a printer and a facsimile machine etc., using an electrophotographic process as generally disclosed, for example, in U.S. Pat. No. 5,002,266 for Sheet Feed Apparatus For Image Forming Apparatus issued to Kikuchi et al., a photosensitive drum is uniformly charged to a predetermined potential, and the charged portion of the photosensitive drum is exposed to a light image of an original document being reproduced. This creates an electrostatic latent image corresponding to the document image on the photosensitive drum. After the electrostatic latent image is formed on the photosensitive drum, the latent image is developed by applying toner particles from a developing unit into contact with the latent image formed on the photosensitive drum. This forms a toner image of the original document on the photosensitive drum which is subsequently transferred and fixed on a recording medium. When a toner image is fixed on a recording medium, the toner image is first heated and fused onto the recording medium, and then naturally cooled so that it is fixed onto the recording medium.

Generally, as a unit for charging the surface of the photosensitive drum, a charging roller such as disclosed in U.S. Pat. No. 5,479,243 for Image Forming Apparatus And Charging Device Thereof issued to Kurokawa using a so-called contact (or direct) charging scheme or a corona wire using a corona discharging scheme may be used to produce an uniform electric field in response to application of high voltage for charging the surface of the photosensitive drum to a constant potential to attract toner particles and thereby form the latent image on the photosensitive drum. Typically, a charging unit is charged at the start of a printing operation. The surface of the photosensitive drum is charged and a developing unit is concurrently charged by way of the charging unit as the photosensitive drum rotates in a direction opposite to the rotation of the developing unit. As a result, an electrostatic latent image is formed on the photosensitive drum and the latent image is then visualized as a toner image by the developing unit. The charged area of the photosensitive drum is then exposed to a laser beam. Because of the potential difference between the exposed area and the unexposed area of the photosensitive drum the toner particles are attracted only to the exposed area to form the toner image on the photosensitive drum. The toner image is then transferred to the recording medium. After the toner image is transferred to the recording medium, the photosensitive drum is charged back to an original voltage as the recording medium is being conveyed to a fixing unit. When the toner image is fixed on the recording medium by the fixing unit, the photosensitive drum is charged to a reference voltage. The residual toner on the surface of the photosensitive drum is then cleaned by a cleaning blade of a cleaning device and is collected as waste toner in an interior of the cleaning device such as disclosed in U.S. Pat. No. 5,260,754 for Cleaning Unit For An Image Forming Apparatus issued to Yano et al., U.S. Pat. No. 5,543,906 for Cleaning Apparatus Disposed On An Image Forming Apparatus issued to Kanda, and U.S. Pat. No. 5,559,593 for Cleaning Device For An Image Forming Apparatus issued to Yoshinaga et al.

The charging unit also need to be cleaned because its surface often becomes contaminated with fine dust particles. Cleaning techniques for such a charging unit are well known in the art such as disclosed in U.S. Pat. No. 5,506,669 for Cleaning Device Having Potential Applying Member And Image Forming Apparatus Having Reciprocating Recording Material Carrying Member issued to Inoue et al., U.S. Pat. No. 5,541,717 for Cleaning Method For Contact Charging Means In Image Forming Apparatus issued to Saito et al. More sophisticated cleaning technique for the charging unit is recently disclosed, for example, in U.S. Pat. No. 5,557,375 for Contact Type Charging Device And Image Forming Apparatus Having The Same issued to Nagayasu et al., in which the charging unit is positioned at a cleaning position where foreign matter adhering thereto is removed. The cleaning of the charging unit is further enhanced by application of a voltage to the photosensitive drum during cleaning.

In such an image forming apparatus, however, the charging unit is separately installed to perform the charging operation at an outer surface of the photosensitive drum. Similarly, the cleaning blade is separately installed at the cleaning device to clean the residual toner remaining on the outer surface of the photosensitive drum. As a result, production cost can be relatively high. Production components required to assemble the image forming apparatus are unnecessarily augmented. Production time can be prolonged and product size may be undesirably enlarged.

SUMMARY OF THE INVENTION

Accordingly, it is therefore an object of the present invention to provide an improved image forming device having a cost efficient and simplified structure.

It is another object to provide an improved cleaning device in an image forming apparatus using an electrophotographic process for efficiently charging a surface of a photosensitive drum and for then cleaning residue toner from the surface of the photosensitive drum.

It is also an object to provide an improved cleaning device in an image forming apparatus having a conductive blade for first charging a surface of a photosensitive in response to application of a charging voltage and for subsequently cleaning residue toner from the surface of the photosensitive drum in response to application of a cleaning voltage.

Those and other objects of the present invention can be achieved by an improved cleaning device in an image forming apparatus using an electrophotographic process including a conductive cleaning blade installed at a cleaning device for removing residual toner remaining on an outer surface of a photosensitive drum; and a high pressure unit electrically connected to the conductive cleaning blade to apply a charging voltage to the conductive cleaning blade to charge the surface of the photosensitive drum during charging operation and to apply a cleaning voltage to the conductive cleaning blade to prepare the surface of the photosensitive drum during cleaning operation.

The present invention is more specifically described in the following paragraphs by reference to the drawings attached only by way of example.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar elements components, wherein.

DETAILED DESCRIPTION OF THE PREFERRED EMBODIMENTS

Figure 1:
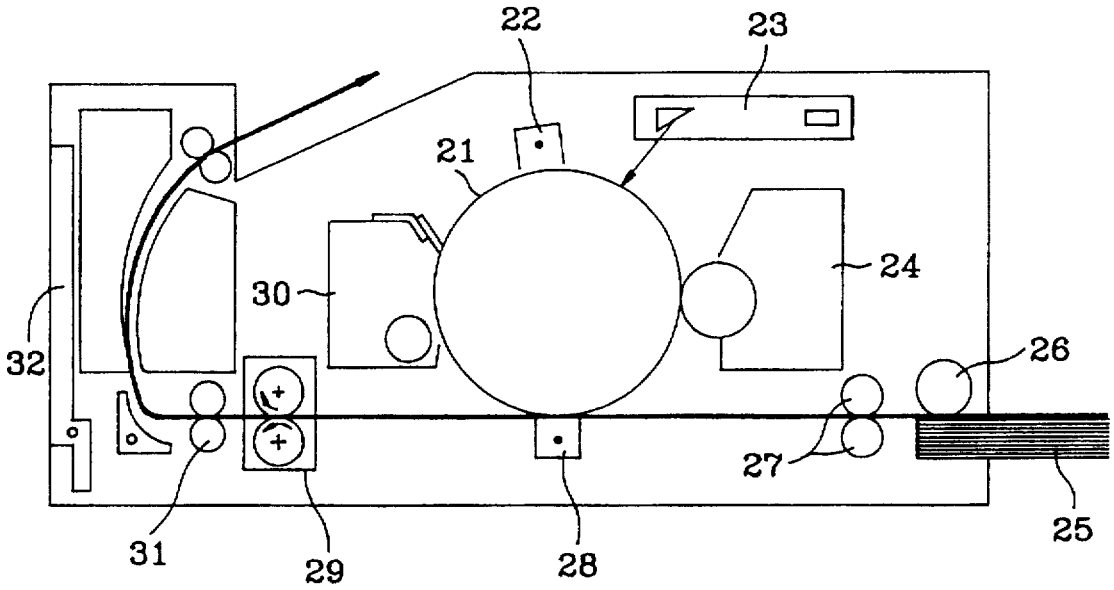
FIG. 1 is an abstract representation of an image forming apparatus using an electrophotographic process.

Referring now to the drawings and particularly to FIG. 1, which is an abstract representation of an image forming apparatus such as a laser beam printer. Generally, such an image forming apparatus includes a photosensitive drum 21, a charging unit 22, a laser scanning unit 23, a developing unit 24, a paper cassette 25 for containing a stack of recording paper, a feed roller 26 for feeding each individual sheet of recording paper for an image formation, a pair of register rollers 27 for registering each individual sheet of recording paper fed by the feed roller 26, a transfer unit 28 for transferring a developed image formed on the photosensitive drum 21 on the recording paper, a fixing device 29 for fixing the developed image on the recording paper, a pair of convey rollers 31 for conveying the recording paper towards an ejection tray 32 along a vertical path for ejection via a pair of ejection rollers 33. The photosensitive drum 21, the charging unit 22, the laser scanning unit 23, the developing unit 24, the transfer unit 28 and the cleaning device 30 collectively constitute an electrophotographic processor.

First, an outer surface of the photosensitive drum 21 is uniformly charged by the corona discharge of the charging unit 22. A laser light generated by a laser diode of the laser scanning unit 23 in response to application of an electric signal is scanned to a rotary optical polygon through a reflection light lens and a cylindrical lens to the photosensitive drum 21. An electrostatic latent image is thus formed on the exposed outer surface of the photosensitive drum 21. At this time, the electrostatic latent image formed is developed with toner while passing through the developing unit 24 so as to form a toner image on the outer surface of the photosensitive drum 21. Thereafter, the toner image formed on the outer surface of the photosensitive drum 21 is transferred by the transfer unit 28 on the recording paper which is fed through register rollers 27 from the paper cassette 25 via the feed roller 26. The transferred recording paper is then conveyed to the fixing unit 29 and passed between a heat roller and a press roller of the fixing unit 29. Here, the toner image is fixed onto the surface of the recording paper by the heat and pressure of the fixing unit 29 so as to form images on the recording paper. Then, the transferred recording paper moves toward an ejecting tray 32. Accordingly, while passing the recording paper through an ejecting roller 31, printing operation is completed and the recording paper is finally ejected. After each printing operation, residual toner 36 remaining on the outer surface of the photosensitive drum 21 which passes through the transfer unit 28 is necessarily removed by the cleaning device 30.

Figure 2:
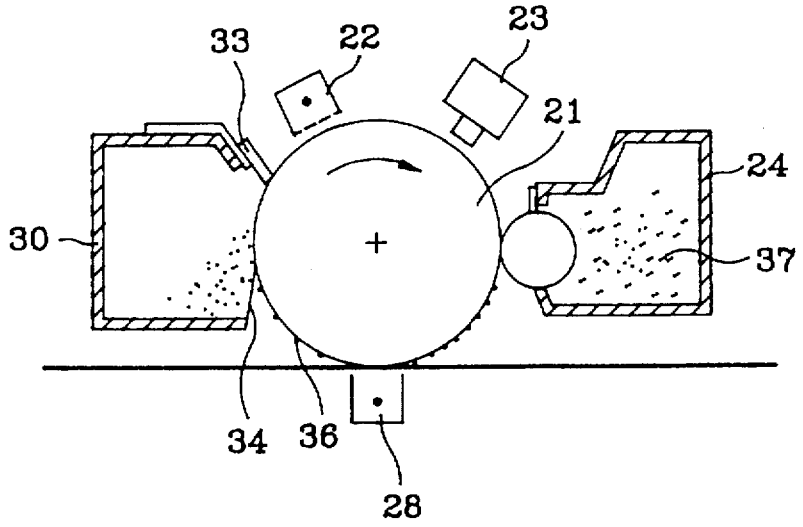
FIG. 2 illustrates a typical electrophotographic processor having a charging device and a cleaning device.

FIG. 2 is a perspective view of the typical electrophotographic processor included in the image forming apparatus of FIG. 1. The electrophotographic processor includes a separate charging unit 22 for charging a surface of a photosensitive drum 21 and a separate cleaning device 30 for cleaning the residue toner remaining on the surface of the photosensitive drum 21 after each printing operation. Operations of the cleaning device 30 of the electrophotographic processor will now be described in detail with reference to FIGS. 1 and 2 as follows.

After the outer surface of the photosensitive drum 21 is charged by the charging unit 22 and the electrostatic latent image is formed at the laser scanning unit 23 as the exposure unit, the electrostatic latent image of the photosensitive drum 21 is developed by toner while passing through the developing unit 24 so as to form a visible image. After that, the visible image formed on the outer surface of the photosensitive drum 21 is transferred by the transfer unit 28 on the recording paper which is fed by the feed roller 26.

Thereafter, the transferred recording paper is passed through the fixing unit 29 so that the toner image can be permanently fixed onto the surface of the recording paper by the heat and pressure of the fixing unit 29 so as to form a desired image on the recording paper. Meanwhile, the residue toner 36 remaining on the outer surface of the photosensitive drum 21 which passes through the transfer unit 28, is cleaned by a cleaning blade 33 of the cleaning device 30 and is thus piled up in an interior of the cleaning device 30. A film seal 34 is attached at a lower portion of the cleaning device 30 so that the cleaned waste toner 36 can be prevented from being leaked outside of the cleaning device 30.

In such an image forming apparatus, however, the charging unit 22 is separately installed to perform the charging operation at the outer surface of the photosensitive drum 21. Similarly, the cleaning blade 33 is separately installed at the cleaning device 30 to clean the residual toner remaining on the outer surface of the photosensitive drum 21. As a result, production cost can be relatively high. Production components required to assemble the image forming apparatus are unnecessarily augmented. Production time can be prolonged and product size may be undesirably enlarged.

Figure 3:
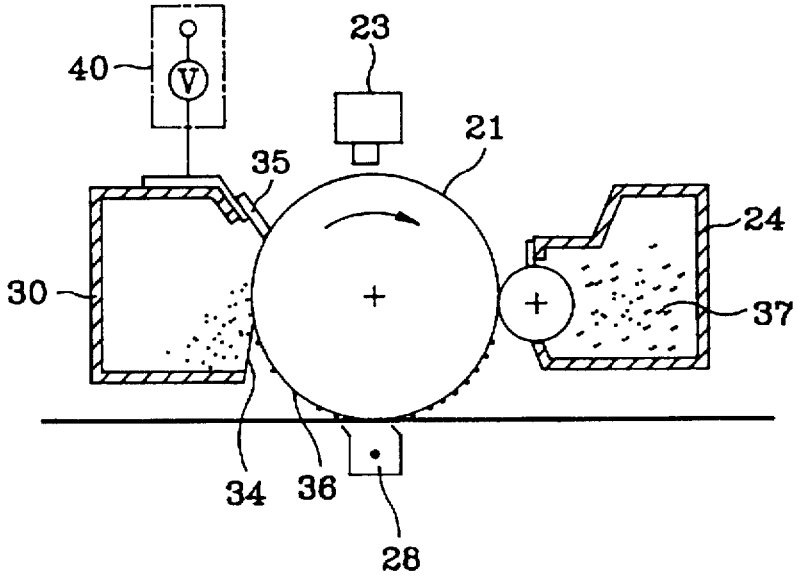
FIG. 3 illustrates an electrophotographic processor having an improved cleaning device constructed according to a preferred embodiment of the present invention.

Turning now to FIG. 3 which illustrates an electrophotographic processor having an improved cleaning device constructed according to the principles of the present invention. The electrophotographic processor includes an improved cleaning device 30 having a conductive cleaning blade 35 for removing the residual waste toner remaining on the outer surface of the photosensitive drum 21 during cleaning operation, and a high voltage unit 40 electrically connected to the conductive cleaning blade 35 to charge the outer surface of the photosensitive drum 21 in response to application of a voltage during charging operation.

Operation and effect of the electrophotographic processor having an improved cleaning device constructed therein will now be described in detail with references to FIGS. 1 and 3 as follows. When a voltage is applied from the high voltage unit 40 to the conductive cleaning blade 35 installed at the cleaning device 30 of the electrophotographic processor, the outer surface of the photosensitive drum 21 is uniformly charged by the conductive cleaning blade 35, a laser light generated by a laser diode in response to application of an electric signal is scanned by a rotary optical polygon through a reflection light lens and a cylindrical lens to the photosensitive drum 21 so as to form an electrostatic latent image on the exposed outer surface of the photosensitive drum 21. At this moment, the electrostatic latent image is developed with toner while passing through the developing unit 24 so as to produce a visible image on the outer surface of the photosensitive drum 21. Thereafter, the visible image formed on the outer surface of the photosensitive drum 21 is then transferred by a transfer unit 28 on the recording paper which is fed through register rollers 27 by the feed roller 26 from the paper cassette 25. The transferred recording paper is then conveyed to the fixing unit 29 and passed between a heat roller and a press roller of the fixing unit 29. Here, the toner is fixed onto a surface of the recording paper by the heat and pressure of the fixing unit 29, thereby forming a desired image at the recording paper. Then, the transferred recording paper moves toward an ejecting tray 32. Accordingly, while passing the recording paper through an ejecting roller 31, printing operation is completed and the recording paper is finally ejected.

In the meanwhile, the residual waste toner 36 remaining on the outer surface of the photosensitive drum 21 which passes through the transfer unit 28 is removed by the conductive cleaning blade 35 provided at the cleaning device 30. The waste toner 36 removed by the conductive cleaning blade 35 is collected in an interior of the cleaning device 30. A film seal 34 is adhered to a lower portion of the cleaning device 30 in order to prevent the waste toner 36 from being leaked outside of the cleaning device 30.

The voltage applied from the high voltage unit 40 for the sake of charging the outer surface of the photosensitive drum 21 as described previously, enables the outer surface of the photosensitive drum 21 to be charged through the conductive cleaning blade 35. Consequently, the residual toner 36 remaining on the surface of the photosensitive drum 21 after being transferred at the outer surface of the photosensitive drum 21 can be cleaned by the conductive cleaning blade 35 so as to simplify the image forming apparatus.

Figure 4:
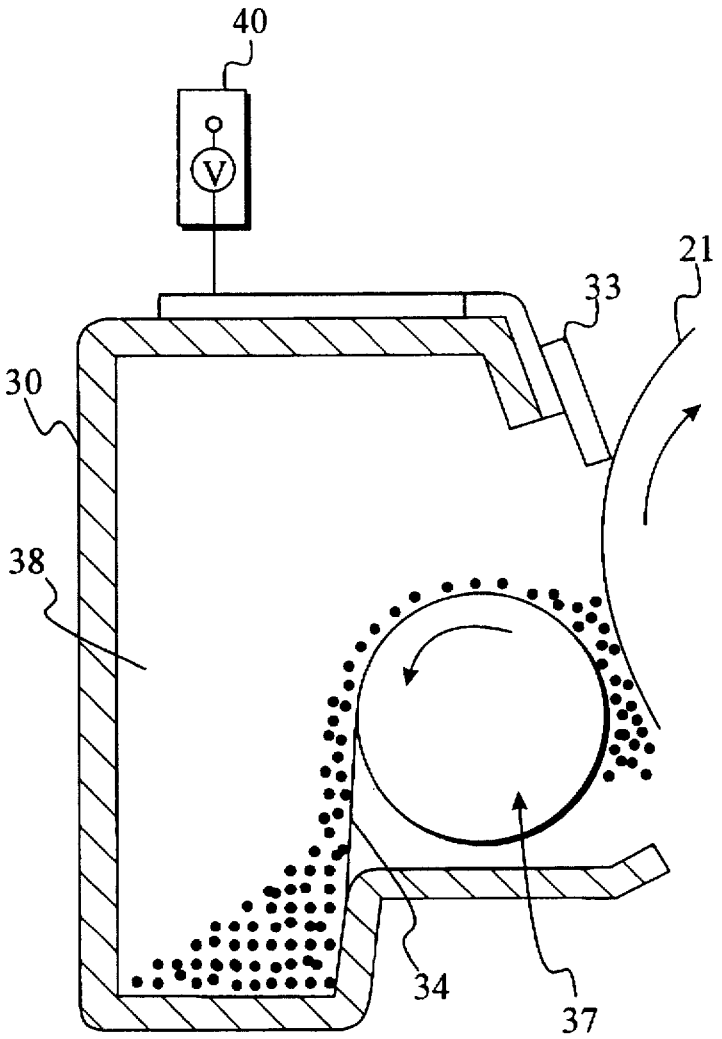
FIG. 4 illustrates an improved cleaning device constructed according to a second embodiment of the present invention.

FIG. 4 illustrates an improved cleaning device constructed according to a second embodiment of the present invention. In this embodiment, the cleaning device 30 additionally includes a cleaning roller 37 such as a fur brush roller or a magnetic roller disposed to mainly remove paper dust. A conductive cleaning blade 33 is also provided downstream of the cleaning roller 37 to remove residue toner remaining on the photosensitive drum 21. The residue toner and paper dust which are removed by the cleaning roller 37 and the conductive cleaning blade 33 are collected and transported by the cleaning roller 37. A scraper 34 contacts the cleaning roller 37 to collect the residue toner and paper dust in the interior 38 of the cleaning device 30. As is contemplated by the present invention, bias voltage is applied from the high voltage unit 40 to the conductive cleaning blade 33 to charge a surface of the photosensitive drum 21 to a charging level during a charging operation to form a latent image and then a toner image on the photosensitive drum 21. After the toner image formed on the photosensitive drum 21 is transferred on a recording paper, the residue toner remains on the surface of the photosensitive drum 21. The residue toner is then removed by the conductive cleaning blade 33 during a cleaning operation. In order to successfully weaken the electrostatic adhesion of the toner to the photosensitive drum 21 and to promote the separation of the residue toner from the photosensitive drum 21, the present invention also contemplates that another bias voltage preferably a negative voltage be applied from the high voltage unit 40 to the conductive cleaning blade 33 to charge the photosensitive drum 21 so as to reduce the amount of charge deposited thereon and to cause the residue toner to attract to the conductive cleaning blade 33. This will efficiently remove the residue toner remaining on the surface of the photosensitive drum and eliminate the necessity of a separate charging unit.

As may be apparent from the foregoing, the cleaning device of the electrophotographic processor constructed according to the principles of the present invention has many advantages in that the conventional charging unit is eliminated from the electrophotographic processor. The conductive cleaning blade is installed at the cleaning device so as to perform both the charging and cleaning operations in response to application of the voltage generated from the high pressure unit. As a result, production cost can be minimized. Production components required to assemble the image forming apparatus are reduced and valuable production time can be advantageously reduced.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment discloses as the best mode contemplated for carrying out the present invention, but that the present invention includes all embodiments falling within the scope of the appended claims.

What is claimed is:

1. A cleaning device of an electrophotographic processor, comprising:

a cleaning housing having an opening;

a conductive cleaning blade installed on said cleaning housing to cover part of the opening, for removing a residual toner remaining on a surface of a photosensitive drum during a cleaning operation; and a single power source electrically connected to said conductive cleaning blade for applying a first voltage exhibiting a first polarity to said conductive cleaning blade to charge the surface of the photosensitive drum during a charging operation to form a latent image on the photosensitive drum, and for applying a second voltage exhibiting a second polarity opposite of said first polarity to said conductive cleaning blade to charge the surface of the photosensitive drum during said cleaning operation while said conductive cleaning blade removes the residual toner remaining on the surface of the photosensitive drum after said charging operation.

2. The cleaning device of claim 1, further comprising a film seal installed to a lower portion of said cleaning housing to prevent the residue toner collected in said cleaning housing from spilling outside of said cleaning housing.

3. The cleaning device of claim 1, further comprising a cleaning roller provided in said cleaning housing for collecting the residue toner removed by said conductive cleaning blade and transporting the residue toner into said cleaning housing.

4. The cleaning device of claim 3, further comprising a scraper positioned in said cleaning housing in contact with said cleaning roller so as to oppose a rotation direction of said cleaning roller for removing the residue toner on said cleaning roller and transporting the residue toner into said cleaning housing.

5. The cleaning device of claim 4, further comprised of said cleaning roller being spaced apart from the photosensitive drum and disposed to remove paper dust remained on the photosensitive drum.

6. The cleaning device of claim 4, wherein said cleaning roller is a magnetic roller.

7. An image forming apparatus, comprising:

a photosensitive drum;

a cleaning device having a conductive cleaning blade positioned in contact with the photosensitive drum to charge a surface of the photosensitive drum during a charging operation;

exposing means for exposing the surface of the photosensitive drum charged by said conductive cleaning blade;

developing means for developing a latent image electrostatically formed on the photosensitive drum by said exposing means to produce a visible image;

transferring means for transferring the visible image to a recording medium;

fixing means for fixing the visible image transferred to the recording medium; and a single power source electrically connected to said conductive cleaning blade, for applying a first voltage exhibiting a first polarity to said conductive cleaning blade to control the charging of the surface of the photosensitive drum during said charging operation to form said latent image on the photosensitive drum, and for applying a second voltage exhibiting a second polarity opposite of said first polarity to said conductive cleaning blade to control the charging of the surface of the photosensitive drum during a cleaning operation as said conductive cleaning blade removes a residue toner remaining on the surface of the photosensitive drum after said charging operation.

8. The image forming apparatus of claim 7, further comprised of said cleaning device having a cleaning housing and a film seal installed at a lower portion of said cleaning housing to prevent the residue toner collected therein from spilling outside of said cleaning housing.

9. The image forming apparatus of claim 8, further comprised of said cleaning device having a cleaning roller provided in said cleaning housing for collecting the residue toner removed by said conductive cleaning blade and transporting the residue toner into said cleaning housing.

10. The image forming apparatus of claim 9, further comprised of said cleaning device having a scraper positioned in said cleaning housing in contact with said cleaning roller so as to oppose a rotation direction of said cleaning roller for removing the residue toner on said cleaning roller and transporting the residue toner into said cleaning housing.

11. The image forming apparatus of claim 10, further comprised of said cleaning roller being spaced apart from the photosensitive drum and disposed to remove paper dust remained on the photosensitive drum.

12. The image forming apparatus of claim 11, wherein said cleaning roller is a magnetic roller.

13. A cleaning device for charging an image carrier for carrying an electrostatic latent image, comprising:

a conductive cleaning blade installed to charge a surface of said image carrier during a charging operation and to remove a residual toner remaining on the surface of said image carrier during a cleaning operation; and a single power source electrically connected to said conductive cleaning blade for applying a first voltage exhibiting a first polarity to said conductive cleaning blade to charge the surface of the photosensitive drum during said charging operation to form said electrostatic latent image on the photosensitive drum, and for applying a second voltage exhibiting a second polarity opposite of said first polarity to said conductive cleaning blade to charge the surface of the photosensitive during said cleaning operation to remove the residual toner remaining on the surface of the photosensitive drum;

a cleaning housing for containing the residue toner removed by said conductive cleaning blade;

a cleaning roller provided in said cleaning housing for collecting the residue toner removed by said conductive cleaning blade and transporting the residue toner into said cleaning housing during said cleaning operation; and a scraper provided in said cleaning housing and positioned in contact with said cleaning roller so as to oppose a rotation direction of said cleaning roller for removing the residue toner on said cleaning roller and transporting the residue toner into said cleaning housing during said cleaning operation.

* * * * *